US005135078A

United States Patent [19]

Bell et al.

[11] Patent Number: 5,135,078

[45] Date of Patent: Aug. 4, 1992

[54] PORTABLE SUPPORT SYSTEM FOR SUSPENDING PERSONS FROM BUILDINGS

[75] Inventors: Michael Bell, 1705 Triumphe Way, Warrington, Pa. 19876; Keith Kinney, Phoenix, Ariz.

[73] Assignee: Michael Bell, Warrington, Pa.

[21] Appl. No.: 641,420

[22] Filed: Jan. 15, 1991

[51] Int. Cl.[5] ..... E04G 3/10

[52] U.S. Cl. ..... 182/142; 182/150; 182/152; 182/63

[58] Field of Search ..... 182/142, 153, 17, 152, 182/150, 63, 36, 151; 212/195, 266

[56] References Cited

U.S. PATENT DOCUMENTS

| | | | |
|---|---|---|---|
| 466,010 | 12/1891 | Parmelee | 182/153 X |
| 3,159,110 | 12/1964 | Wylie . | |
| 3,566,990 | 3/1971 | Fredricks | 182/17 |
| 3,608,670 | 9/1971 | Blake . | |
| 3,854,550 | 12/1974 | Shingler | 182/142 X |
| 4,130,179 | 12/1978 | Williams . | |
| 4,235,055 | 11/1980 | Beeche . | |
| 4,274,507 | 6/1981 | Williams . | |
| 4,296,905 | 10/1981 | Powell . | |
| 4,454,928 | 6/1984 | Marteau et al. . | |
| 4,496,027 | 1/1985 | Fisher . | |
| 4,534,447 | 8/1985 | Champigny | 182/152 |
| 4,801,117 | 1/1989 | Take | 182/142 X |
| 4,817,758 | 4/1989 | Gilmore . | |

*Primary Examiner*—Alvin C. Chin-Shue

*Attorney, Agent, or Firm*—Caesar, Rivise, Bernstein, Cohen & Pokotilow

[57] ABSTRACT

A portable support system for use on the roof of a building to support an object and/or person therefrom. The system is arranged to be readily rolled to a desired position adjacent the edge of the roof and includes two wheeled frame assemblies and a collapsible/extendable boom assembly. The boom assembly comprising pivotable sections arranged to be extended from a compact orientation to an extended orientation and vice versa. The frame assemblies are arranged for connection to respective portions of the boom assembly. When the boom assembly is in the compact orientation the frame assemblies are closely connected together via plural connecting members to form a compact cart. The frame assemblies each include a pair of spaced wheels which can pivot in any direction to enable the cart to be readily wheeled to a position at the edge of the roof. The frame assemblies are then disconnected from the connecting members, and the boom sections extended so that the frame assemblies are spaced further apart for stability. A portion of the boom assembly extends over the edge of the roof to support a person/object therefrom. When the system is in position supporting the person/object the wheels are locked into an orientation so that they may only roll in directions transverse to the axis of the extended boom so that the system may roll along the edge of the roof, if desired.

30 Claims, 6 Drawing Sheets

PORTABLE SUPPORT SYSTEM FOR SUSPENDING PERSONS FROM BUILDINGS

BACKGROUND OF THE INVENTION

This invention relates generally to safety apparatus and more particularly to systems for location on the roof of a building or other structure for supporting an object or person therefrom.

It has become a common practice to utilize equipment mounted on the roof of a structure to suspend a person or an object, e.g., scaffolding, therefrom to enable a person to work on the exterior of the building, e.g., wash the building's windows. Many types of support equipment have been used to date. Some types of equipment are arranged to be permanently, stationarily mounted on the roof, see for example, U.S. Pat. No. 4,296,905 (Powell). Other types while being permanently mounted are nevertheless moveable along the roof to facilitate their use, see for example, U.S. Pat. Nos. 3,159,100 (Wylie), 3,854,550 (Shingler), 4,235,055 (Beeche), and 4,454,928 (Marteau et al).

For many applications it has been found desirable to make such support apparatus portable so that it may be readily transported to the roof for use. Typically such portable apparatus are arranged as somewhat compact, wheeled assemblies which include a beam or boom arranged to be extended over the edge of the roof to support a person or object therefrom when the apparatus is in the desired location, e.g., adjacent the edge of the roof. Examples of prior art portable support systems are found in the following U.S. Pat. Nos. 3,608,678 (Blake et al), 4,130,179 (Williams), 4,274,507 (Williams), 4,496,027 (Fisher), 4,801,117 (Take), and 4,817,758 (Gilmore).

While the foregoing portable systems are generally suitable for their intended purposes all suffer from one or more of the following drawbacks, e g., large size, heavy weight, complex construction, expense, difficulty to assemble/disassemble, difficulty to transport to the roof, difficulty to position when on the roof, etc. Accordingly, a need exists for a portable support system which overcomes the disadvantages of the prior art.

OBJECTS OF THE INVENTION

It is a general object of this invention to provide a portable support system for location on the roof of a building which overcomes the disadvantages of the prior art.

It is another object of this invention to provide a portable support system which is simple in construction.

It is still another object of this invention to provide a portable support system which may be readily assembled and disassembled.

It is a further object of this invention to provide a portable support system which is arranged to be readily organized into a compact, cart-like configuration for ease of movement and/or storage and which may be readily organized into a larger, operative configuration for supporting a person/object therefrom.

It is yet another object of this invention to provide a portable support system which is readily adjustable to enable its effective and safe use on various types of buildings.

SUMMARY OF THE INVENTION

These and other objects of this invention are achieved by providing a portable support system for use on the roof of a structure. The portable support system is arranged to be readily configured as a compact cart adapted to be readily rolled to any desired location, while also being arranged to be readily configured to an operative configuration for location at an operative position adjacent the edge of the roof to support a person and/or object therefrom.

The system comprises first and second wheeled frame assemblies and a boom assembly. The boom assembly comprises plural sections, each of the sections being moveable with respect to an adjacent section to enable the sections to be unfolded from a compact orientation when the system is configured as the cart to an extended orientation when the system is in the operative configuration, and vice versa.

The wheeled frame assemblies are arranged for connection to respective portions of the boom assembly and are spaced apart by a first predetermined distance when the system is configured as the cart, while being spaced apart by a second, and greater, predetermined distance when the system is in the operative configuration. When the boom assembly is in the extended orientation it includes a portion which extends along a longitudinal axis beyond the first frame assembly to overhang the edge of the roof to support a person and/or object therefrom.

Each of the wheeled frame assemblies comprises a pair of spaced wheels, each of which is arranged to pivot to various orientations to enable the wheel to roll in various directions to facilitate the movement of the system on the roof, while also being arranged to be locked into a first predetermined orientation.

DESCRIPTION OF THE DRAWINGS

Other objects and many attendant features of this invention will become readily appreciated as the same becomes better understood by reference to the following detailed description when considered in connection with the accompanying drawings wherein.

DETAILED DESCRIPTION OF THE PREFERRED EMBODIMENTS

Figures 1, 8:
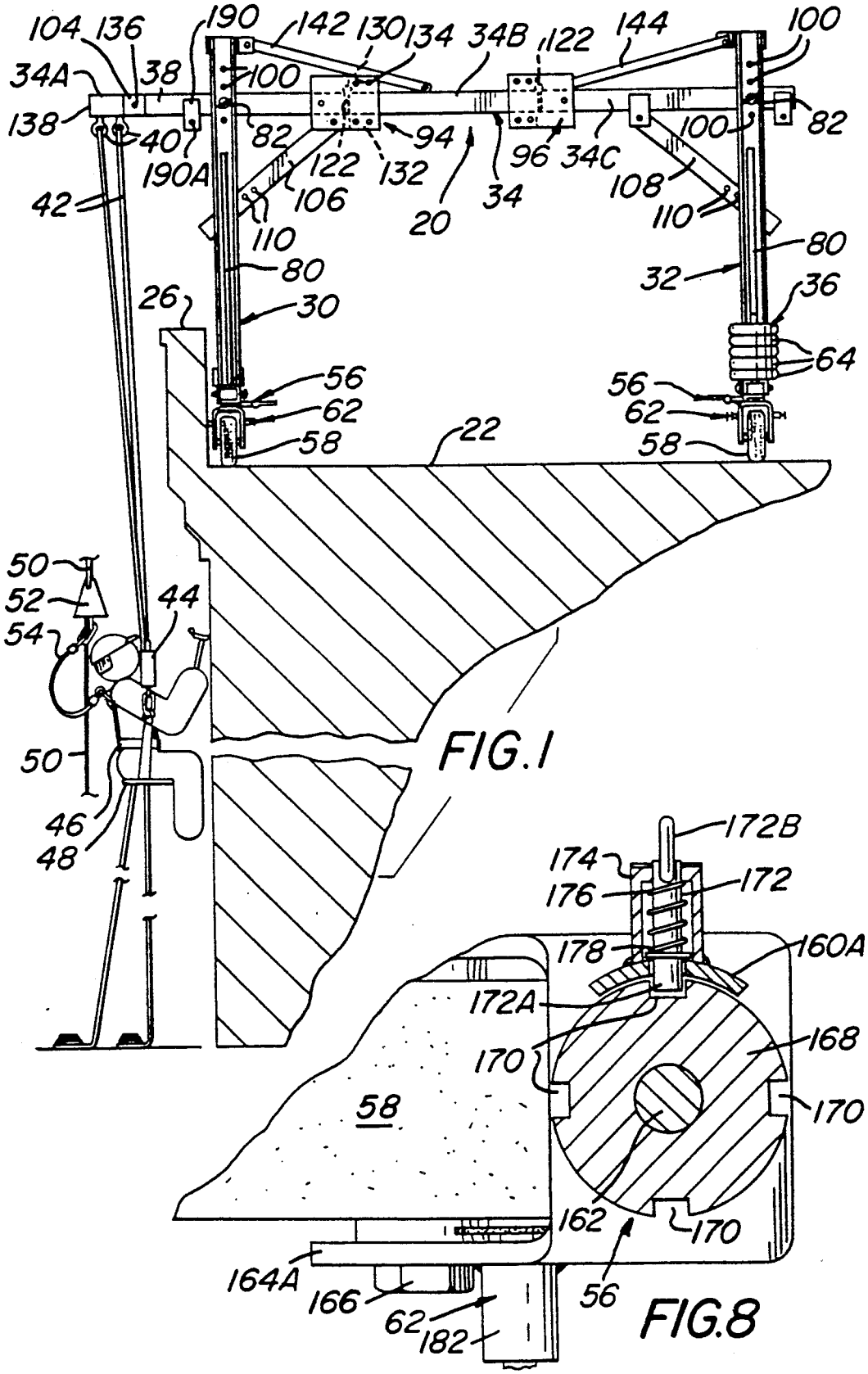
FIG. 1 is a side elevation view of a portable support system constructed in accordance with this invention shown configured in its "operative" configuration and located on the roof of a building for supporting a person therefrom.
FIG. 8 is an enlarged, sectional view taken along line 8—8 of FIG. 6.

Referring now to various figures of the drawing where like reference numerals refer to like parts there is shown at 20 in FIG. 1 a portable support system constructed in accordance with this invention.

Figures 2, 4:
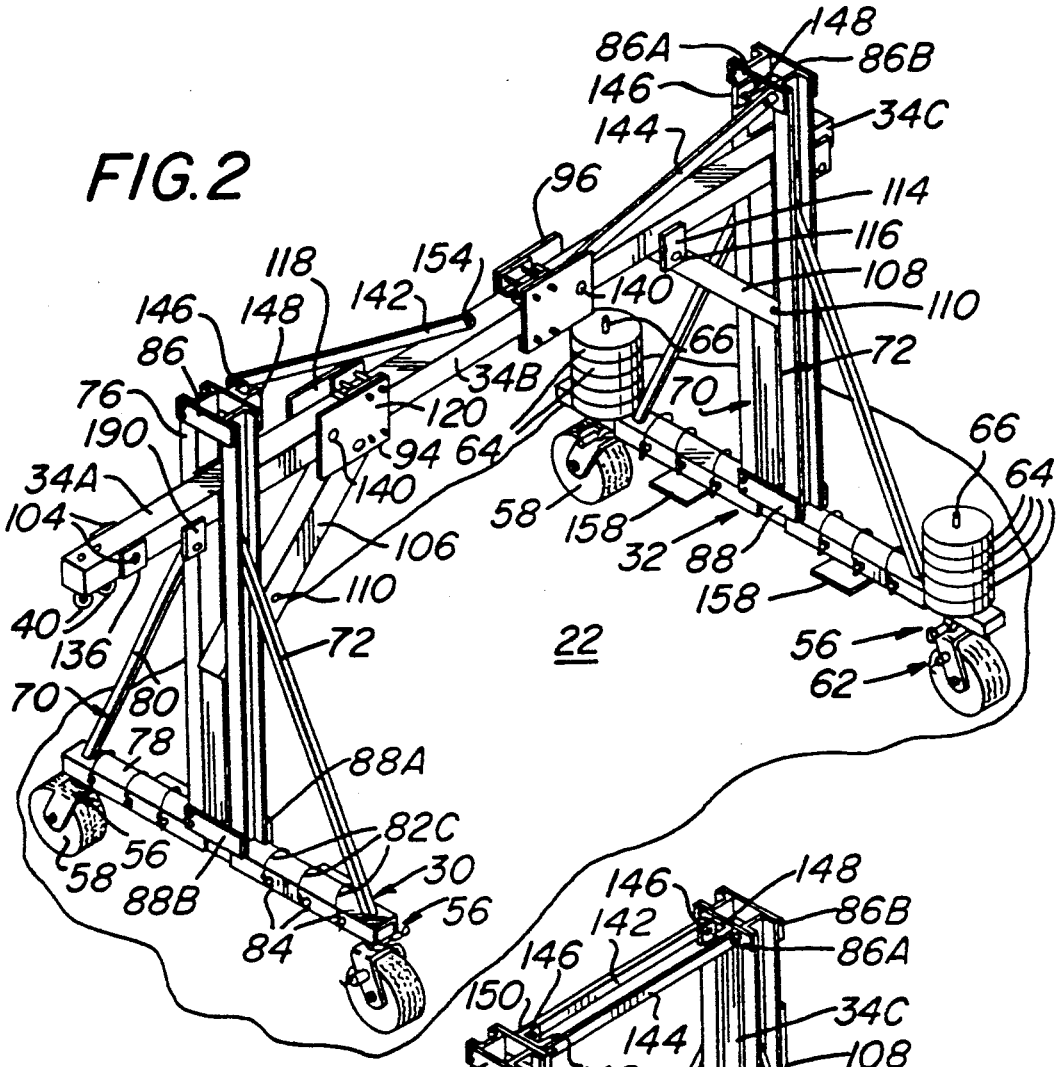
FIG. 2 is an isometric view of the "operative" configuration of the system shown in FIG. 1.
FIG. 4 is an isometric view of the system shown in FIG. 2 in its "cart-like" configuration.

The portable support system is a modular system made up of various assemblies, subassemblies, and components which are relatively light-weight and compact in size so that they can be readily stored and transported to the site, e.g., building, at which the system will be used. The assemblies, subassemblies, and components are arranged to be readily assembled using quick acting releasable securement means when the system is located at the site. Moreover, in accordance with a preferred embodiment of this invention the system is arranged to be assembled into either of two configurations. In one configuration, referred to as the "operative" configuration the system is arranged as shown in FIGS. 1 and 2 to be positioned on the roof 22 of a building 24 or some other structure adjacent its parapet or edge 26 to serve as a means for supporting a person 28 safely therefrom. The other configuration of the system 20 is in the form of a more compact, and readily moveable, cart-like assembly like that shown in FIG. 4. It is in this configuration that the system may be readily moved about the roof of the building and/or stored away.

Owing to its modular construction and quick acting releasable securement means, the system 20 can be readily converted from its operative configuration to its cart-like configuration and vice versa, as desired.

The system 20 basically comprises a wheeled front support assembly 30, a wheeled rear support assembly 32, an extendable/collapsible boom assembly 34, and stabilizing means 36. The details of those assemblies/-means will be described later. Suffice it for now to state that the wheeled support assemblies 30 and 32 establish the frame of the system and support the boom assembly thereon in either an extended (operative) orientation or a collapsed (storage) orientation, depending upon whether the system is in the operative configuration or cart-like configuration.

As can be seen in FIG. 1, when the system 20 is in the operative configuration the boom assembly 34 is supported from the two wheeled frame assemblies 30 and 32 so that a free end portion 38 of the boom assembly 34 overhangs the building's parapet 26 at the edge of the roof 22. The extending portion 38 of the boom includes a pair of downwardly oriented eye bolts 40. These eye bolts serve as connection means for supporting a pair of lines 42 on which a conventional lowering or repelling device 44 is mounted. The device 44 may be of any suitable construction. One particularly effective, commercially available lowering device is the "SKY GENIE" device sold by Descent Control, Inc. of Fort Smith, AR. Other examples of lowering or repelling devices may be found in U.S. Pat. Nos. 3,220,511 and 3,250,515.

As is conventional the lowering or repelling device 44 serves to support a person therefrom. In the embodiment shown a person 28, e.g., window washer, is shown supported from the device 44 via a harness 46 having a seatboard assembly 48 connected thereto.

As is required by federal safety standards, in order to prevent the workmen from falling should the support lines 42 fail, another safety line 50 is provided. The safety line extends from a fixed anchor (not shown) on the roof over the parapet 26 and downward to the ground. A conventional rope grab device 52 is mounted on the line 50 and is connected via a lanyard 54 to the harness 46 supporting the worker.

In order to facilitate the placement of the system 20 at the desired location shown in FIG. 1 the two frame assemblies 30 and 32 each include a pair of caster assemblies 56 mounted thereon. The details of the caster assemblies will be described later. Suffice it for now to state that the caster assemblies each include a caster or wheel 58 which is arranged to freely pivot about a vertical axis 60 so that the caster may be oriented in any directions with respect to that axis, whereupon the system can be rolled in any direction and along any path, linear or curved, to facilitate the location of the system 20 at a desired position. Moreover, the caster assemblies each include means (to be described later) to lock the caster or wheel in one of a preselected number of orientations with respect to the vertical axis 60 when restricted movement of the system is desirable. For example, when the system 20 is in the operative configuration and located at the edge of the roof, like that shown in FIG. 1, the casters 58 are locked in an orientation transverse to the beam assembly so that they may only roll in either direction along the parapet 26. This restricted movement enables the worker to readily perform his/her task along the length of the building under the parapet without compromising safety. Moreover, each of the caster assemblies has associated with it a respective wheel lock assembly 62 (to be described later) which is actuatable to prevent the rolling of the caster 58, to thereby fixedly position the system 20 at a desired location and to preventing the system from being inadvertently moved (i.e., rolled) therefrom, if such action is desired.

Figure 9:
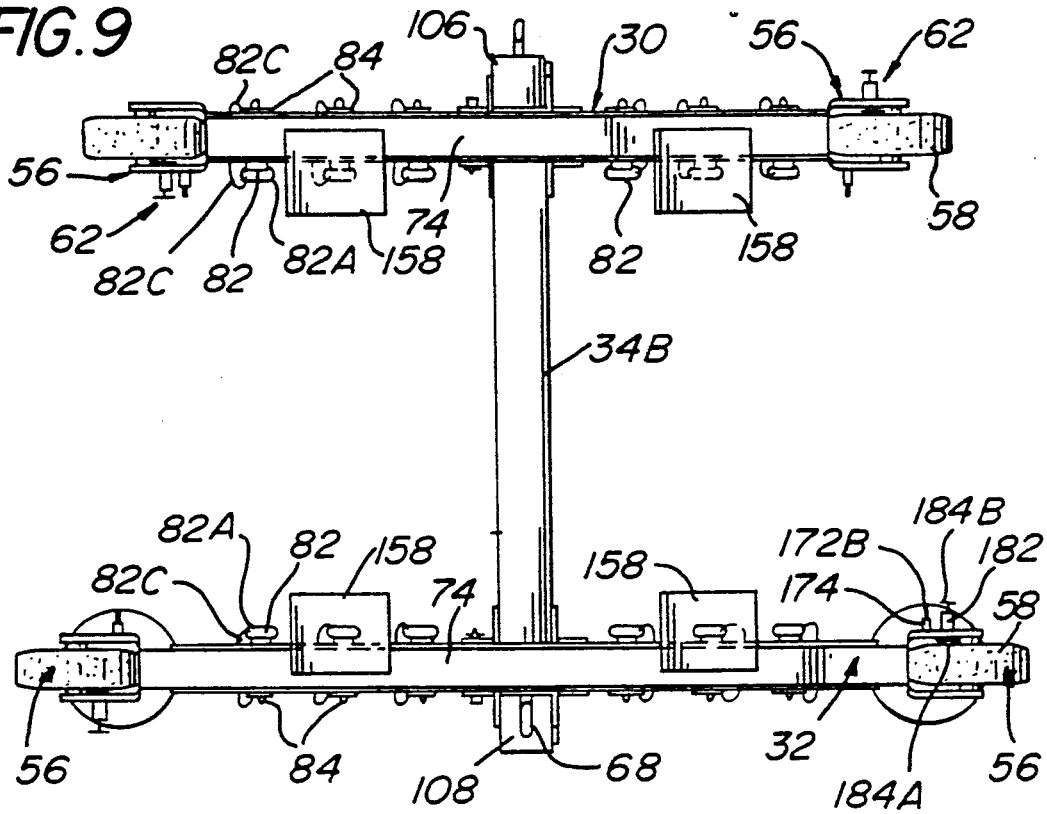
FIG. 9 is a top plan view of the system when arranged in the cart-like configuration shown in FIG. 4.

When the system is in its operative configuration, like that shown in FIGS. 1 and 2, the boom assembly 34 is extended, i.e., it's various sections (to be described later) are axially aligned, the two wheeled frame assemblies 30 and 32 are separated from each other by substantial distance, e.g., eight feet, to ensure that the system is stable (i.e., to resist tipping when supporting the load). The heretofore stabilization means 36 provides additional stabilization for the system. That means basically comprises a plurality of conventional, disk-like, weights 64 which are stacked up on a pair of upstanding rods 66 mounted on the rear wheeled support assembly 32. An eye bolt 68 (FIG. 9) is secured to the rear wheeled assembly 32 at a lower portion thereof to serve as a convenient means for securing the system 20 via a cable (not shown) to any conventional fixed anchor on the roof 22.

Each of the wheeled frame assemblies 30 and 32 are of modular construction and comprise two frame-like subassemblies and associated components. Thus, as can be seen clearly in FIG. 5, the front frame assembly 30 basically comprises a pair of generally triangular frame-like subassemblies 70 and 72, and an elongated base member 74. Each of the subassemblies 70 and 72 basically comprises an upstanding or vertical mast 76, a bottom member 78, and an angularly extending strut 80. Preferably each of the members 76, 78, and 80 is formed of a light-weight, yet strong, e.g., aluminum, U-shaped channel member. The members are fixedly secured together, e.g., welded. The base member 74 is an elongate member formed of rectangular tubular stock, e.g., steel, to which the caster assemblies 56 are secured, e.g., welded.

Figure 10:
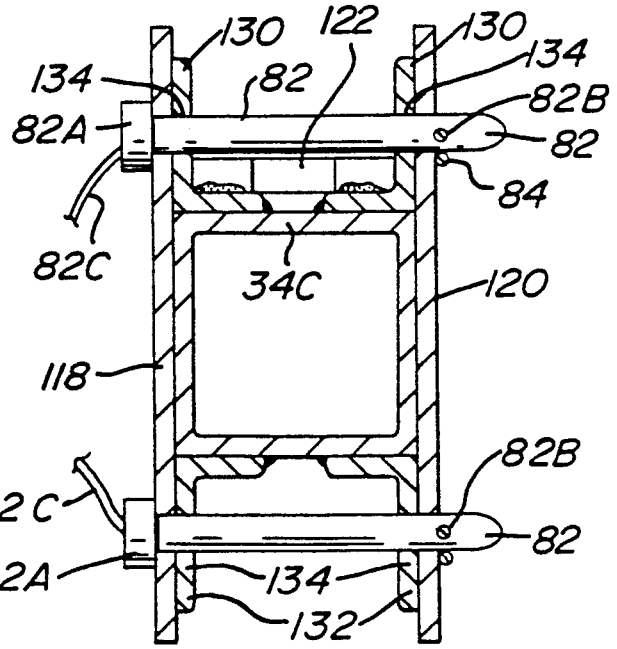
FIG. 10 an enlarged, sectional view taken along line 10—10 of FIG. 3.

The subassemblies 70 and 72 are connected together and to the base member 74 to form the two wheeled support assemblies 30 and 32 via the use of quick-acting, releasably securable fasteners and associated components. In accordance with a preferred embodiment of this invention those fasteners comprise conventional linch pins 82. As is conventional and as can be seen clearly in FIG. 10 each linch pin 82 is an elongated member having an enlarged head 82A at one end and a hole 82B at the other. A ring or clip 84 arranged to extend through the hole 82A at the end of the linch pin to hold it in place. The clip and linch pin are connected together via a wire 82C to prevent the linch pin and clip from being separated from each other.

Figure 5:
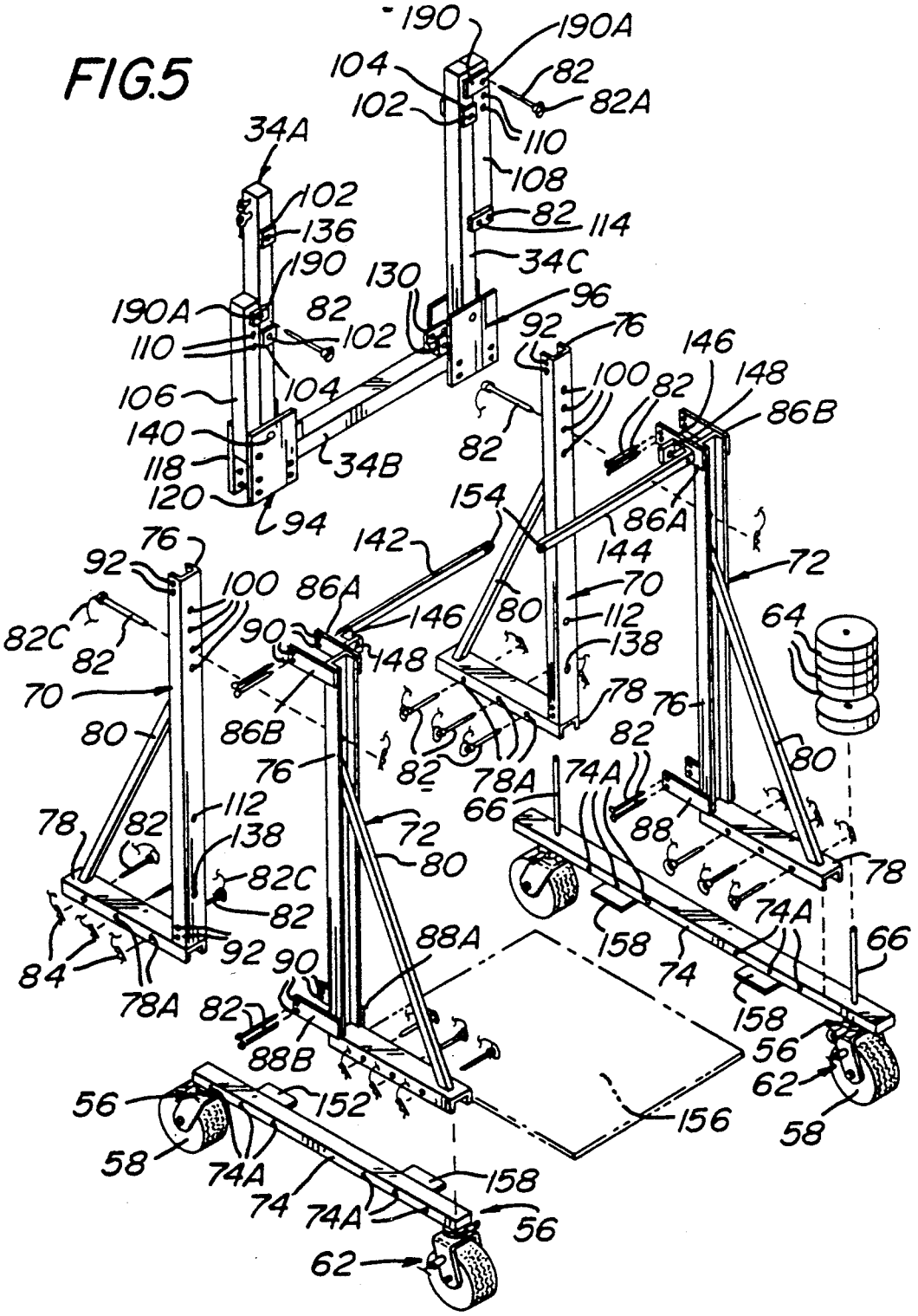
FIG. 5 is an exploded, isometric view of the system in its cart-like configuration like that shown in FIG. 4.

As can be seen in FIG. 5 the two subassemblies 70 and 72 are oriented so that their bottom members 76 are disposed over and surround the top and sides of the elongated base member 74. The bottom members 78 each include plural aligned holes 78A therein which are aligned with corresponding holes 74A in the elongated base member 74. Respective linch pins 82 are inserted in the aligned holes 74A and 78A and the clips 84 connected to secure the subassemblies 70 and 72 to the base member 74. The masts 76 of the subassemblies 70 and 72 are spaced slightly apart, e.g., 4 inches, to accommodate the boom assembly 34 therebetween (as will be described later). The subassemblies are connected at that spacing via two pairs of connecting straps. One pair of straps 86 is located at the top of the mast 76 of subassembly 72, while the other pair 88 is located at the bottom of that mast.

As can be seen clearly in FIG. 4 the upper pair of connecting straps comprises an inner strap 86A and an outer strap 86B. The straps are short members which are fixedly secured, e.g., welded, to the side flanges of the mast 76 of the subassembly 72. Each strap includes a pair of holes 90 in its free end and which are aligned with holes 92 in the upper end of the side flanges of the mast 76 of the subassembly 70. Respective linch pins 82 are extended through the aligned hole 90 and 92 and are held in place by respective clips 84. The straps 88A and 88B of the lower pair secure the two mast 76 together in an identical manner as the upper straps.

As can be seen clearly in FIGS. 1–4, the boom assembly 34 basically comprises three sections 34A, 34B, and 34C. Each of the sections is formed of a hollow tubing of square cross section. In accordance with the preferred embodiment of the invention the boom is formed of four inch square aluminum tubing. The sections 34A and 34B are hingedly connected together via a hinge assembly 94. In a similar manner the sections 34B and 34C are connected together by a second hinge assembly 96. Each hinge assembly is arranged to enable the associated boom sections to be pivotally connected to each other so that they can be moved from the compact orientation like that shown in FIG. 4 to the extended orientation like that shown in FIGS. 1 and 2, and vice versa. Moreover, the hinge assemblies are disconnectable so that the three boom sections 34A–C can be disconnected from one another.

When the boom assembly sections are in their extended orientation they are axially aligned so that the boom extends along a common longitudinal axis 98 (FIG. 3), with the section 34A extending substantially, e.g., two feet beyond the front wheeled support assembly 30.

The boom assembly is arranged so that when it is in its extended orientation it can be supported at various heights with respect to the roof by the two support assemblies 30 and 32. This feature ensures that the system can be used for a wide variety of roof-top applications. To that end, each of the masts 76 of the support assemblies 30 and 32 includes a plurality of vertically spaced holes 100 (FIG. 5). The holes 100 of the masts are aligned and are spaced from one another by any predetermined distance, e.g., several inches. The front or extending section 34A of the boom assembly includes a hole 102 extending therethrough. As clearly seen in FIG. 5 pair of apertured reinforcing plates 104 are fixedly secured, e.g., welded, to the sides of the boom section 34A at the location of the hole 102 to reinforce it. A linch pin 82 is arranged to extend through any of the selected aligned holes 100 in the masts of the front assembly 30 and through the hole 102 in the front section 34A of the boom assembly to hold the front end of the boom assembly at the height of the selected hole 100. The rear section 34C of the boom assembly also includes a hole 102 which is similarly reinforced by plates 104. Another linch pin 82 is arranged to extend through a selected holes 100 in the upper portion of the opposed mast members of the rear support assembly 32 and the hole 102 in the mast section 34C to hold the rear end of the boom assembly at the height of the selected holes 100.

The details of the hinge assemblies 94 and 96 will be described later. Suffice it for now to state that those assemblies are arranged to hold the associated boom sections in axial alignment so that they extend along longitudinal axis 98. In order to reinforce or provide additional support for the boom sections when they are in their axially aligned orientation like that shown in FIGS. 1 and 2 the system 20 includes a pair of bracing struts 106 and 108 pivotally connected to the boom assembly. The strut 106 is arranged to be connected to the front support assembly 30, while the strut 108 is arranged to be connected to the rear support assembly 32. Each of the struts is preferably formed of a tubular member, like those making up the boom sections 34A–34C, and includes a free end (to be described hereinafter) which is arranged to be disposed and releasably secured within the space between the two masts 76 of a respective, associated wheeled support assembly.

The front bracing strut 106 is pivotally secured to the front boom section 34A via the front hinge assembly, while the rear bracing strut 108 is pivotally secured to the rear boom section 34C via means (to be described later). The free end of the bracing strut 106 includes a plurality of holes 110 extending therethrough. The holes 110 serve as means for connecting the free end of the strut 106 in the space between the masts 76 forming the front support assembly 30. To achieve that end those masts each include an intermediately located hole 112. The holes 112 are axially aligned with each other and are arranged to be aligned with a selected one of the holes 110 at the end of the strut 106 so that a linch pin 82 can be extended therethrough to secure the strut to the front support assembly 30. The bracing strut 108 is constructed in a similar manner to strut 106 and is arranged to be connected at its lower end in the space between the two masts 76 of the rear support assembly 32 in the same manner as that described heretofore.

Figure 3:
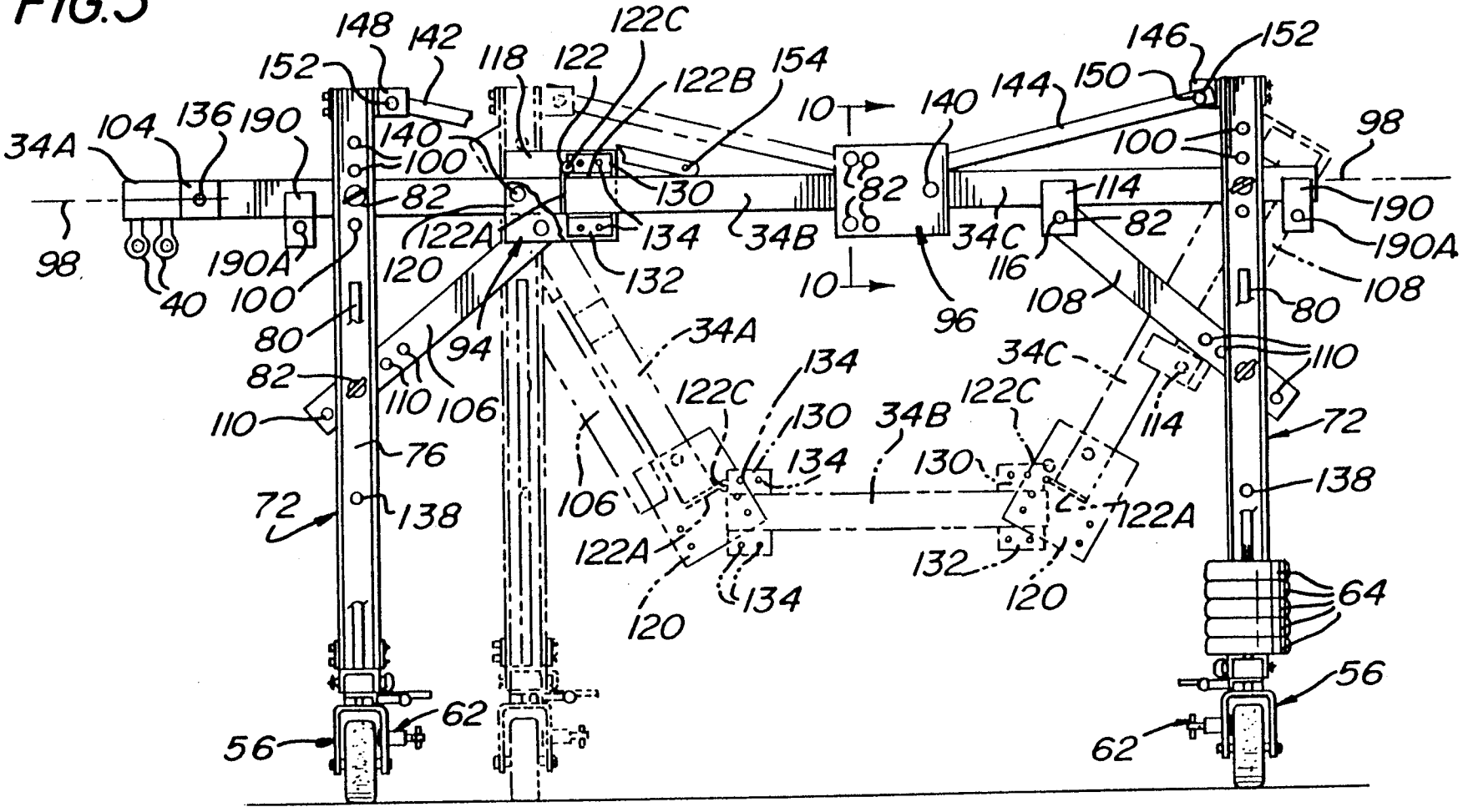
FIG. 3 is an enlarged side elevation view of the system of FIG. 1 and showing its conversion between its "operative" configuration and a more compact, "cart-like" configuration.

As can be seen in FIGS. 1, 3, and 5 the front bracing strut 106 is connected to the front hinge assembly 94 via a linch pin 82 extending through a pair of plates (to be described later) forming a portion of the hinge assembly so that the bracing strut is pivotally connected to the boom section 34A. The rear support strut 108 is pivotally connected to the boom section 34C via mounting bracket 114 fixedly secured, e.g., welded, to the undersurface of the boom section. The bracket includes a pair of aligned holes 116 which are aligned with a hole in the end of the support strut. A linch pin 82 extends through those aligned holes and is held in place by an associated clip 84 so that the bracing strut is pivotally secured to the boom section.

In accordance with the preferred embodiment of the invention, when the boom assembly its extended orientation, can be positioned so that it extends at an inclined angle to the roof, i.e., is not horizontal. Thus, if it is desired to have the front extending section of the boom assembly at a higher elevation than the rear section all that is required is to remove the linch pin 82 from the hole 102 in the boom section and the holes 100 in the front support assembly, while also removing the linch pin 82 securing the lower end of the support strut 106 to that assembly via intermediately located holes 112. The other support strut 108 must also be disconnected from its connection between the two opposed masts of the support assembly 32 to enable the beam to be oriented at the desired angular orientation. This is accomplished by removing the linch pin 82 connecting the lower end of that boom section to the mast forming the rear support assembly 32. The forward end of the boom can then be raised or lowered to the desired orientation, the linch pin 82 extended through the holes 100 in the masts and hole 102 in the front boom section 34A to establish the desired angular orientation. Then the support strut 106 is reconnected to the front support assembly by extending its linch pin through the aligned hole 112 in the opposed masts and an appropriate one of the holes 110 in the end of the support strut 106. The support strut 108 is reconnected to the rear support assembly in a similar manner.

Referring now to FIGS. 1, 2, 3, 5 and 10, the details of the hinge assemblies 94 and 96 will now be described. In the interest of expediency only the details of one of the hinge assemblies will be described, it being understood that the details of the other hinge assembly are identical. Thus, as can be seen, the hinge assembly basically comprises a pair of plates 118 and 120 which are fixedly secured, e.g., welded to the sides of the front strut section 34A at the rear end thereof. The two plates are of substantially greater width than the strut section. A hinge 122 is fixedly secured between the front boom section 34A and the intermediate boom section 34B. That hinge basically comprises a butt plate 122A (FIG. 3) which is fixedly secured, e.g., welded, to the rear end of the front boom section 34A, a second butt plate 122B (FIG. 3) which is fixedly secured, e.g., welded, to the top surface of the intermediate boom section 34B, and a removable pin 122C (FIG. 3). The pin 122C extends between the two butt plates to enable them to pivot with respect to each other. The two side plates 118 and 120 of the hinge assembly each include a hole therein through which the hinge pin 122C may extend. Thus, as should be appreciated by those skilled in the art with the hinge pin 122C in place the front boom section 34A and the intermediate boom section 34B can pivot with respect to each other about the hinge 122.

In order to lock or secure the front boom section 34A and the intermediate boom section 34B in the extended, that is, axially aligned orientation, the hinge assembly 94 also includes two pair of angle brackets 130 and 132. In particular, one pair of angle brackets 130 is fixedly secured, e.g., welded, to the top surface of the intermediate boom section 34B adjacent the front end thereof. A similar pair of brackets 132 are fixedly secured, e.g., welded, on the lower surface of the intermediate boom section adjacent the front end thereof. Each of the brackets includes a pair of holes 134 extending therethrough. The holes are arranged to be aligned with corresponding holes in the two side plates 118 and 120 when the front boom section 34A is axially aligned with the intermediate boom section 34B. Each of the aligned holes 134 is arranged to receive a respective linch pin 82 to lock the two boom sections in the linear orientation. The hinge assembly 96 connecting the boom sections 34B and 34C is identical in construction and operation to the hinge assembly 94, except that it does not provide the pivotable connection point for the rear bracing strut 108 (that strut is pivotally secured to the boom section 34C via the bracket 114 described heretofore).

In order to disassemble the system 20 from its operative configuration, like that shown in FIGS. 1 and 2, to reassemble it into its cart-like configuration, like that shown in FIG. 4, the various linch pins connecting the hinge assemblies 94 and 96 are removed from their respective holes, and the linch pins connecting the lower ends of the two bracing struts 106 and 108 to their associated support assemblies 30 and 32 are also removed. In addition, the linch pin extending through the holes 100 in the front support assembly masts 76 and the aligned hole 102 in the front boom section 34A is removed. In a similar manner the linch pin extending through the holes 100 in the rear support assembly masts and the aligned hole 102 in the rear boom section 34C. The pivot pins 122C of each hinge assembly are left in place. The boom assembly may then be collapsed, i.e., folded to the generally U-shaped configuration shown in FIG. 5.

As seen clearly in FIGS. 1-5 the front section 34A of the boom assembly 34 includes a second hole 136 extending therethrough. A pair of apertured reinforcing plates 104 are fixedly secured, e.g., welded, to the sides of the boom section 34A at the location of the hole 136 to reinforce it. The hole 136 is provided to serve as the connection point for the front section 34A of the boom to the front support assembly 30 when the system is configured as the cart of FIG. 4. Thus, the boom section 34 is moved so that the hole 136 is aligned with the selected ones of holes 100 in the front support assembly masts 76 which had originally been aligned with the hole 102 in the front boom section 34A. The linch pin 82 is then inserted therein and the clip secured to the linch pin. With the linch pin so located the boom assembly may then be folded (pivoted) downward like that shown by the phantom lines in FIG. 3 until the boom sections are in the orientation shown in FIGS. 4 and 5. In this orientation the front boom section 34A and the rear boom section 34B are each disposed vertically between the masts of their respective support assemblies 30 and 32, while the intermediate boom section 34C is disposed horizontally.

In order to hold the boom sections in this compact or collapsed state the two masts 76 of the front support assembly include an aligned pair of holes 138 (FIGS. 3 and 5), while the masts of the rear support assembly also includes that aligned pair of holes. Moreover, each of the plates of the hinge assembly 94 includes an aligned pair of holes 140, while each of the plates of the hinge assembly 96 also includes that aligned pair of holes. When the boom assembly is in its collapsed state one linch pin is extended through the aligned holes 140 and 138 to secure the front hinge assembly to the front support system, and a second linch pin is extended through the corresponding holes to secure the rear hinge assembly to the rear support assembly.

As should be appreciated the foregoing connections firmly secure the lower portions of the two support assemblies 30 and 32 together to form the compact cart-like configuration shown in FIG. 4. In order to ensure that the upper end of those two assemblies are also firmly secured to each other, a pair of releasably securable connecting straps 142 and 144 are provided. To that end, as can be seen in FIG. 5 the inner top cross strap 86A of the front support assembly 30 includes a pair of angle brackets 146 and 148 fixedly secured, e.g., welded, thereon. In a similar manner the inner top cross strap 86A of the rear support assembly and identical pair of angle brackets 146 and 148 fixedly secured, e.g., welded, thereon. Each connecting strap 142 and 144 is elongated member which includes a hole 150 (FIG. 3) at one end thereof. A pin 152 (FIG. 3) extends through the hole 150 in the strap 142 to pivotally connect it to the bracket 146 on the front support assembly, while another pin extends through the hole 150 in the other strap 144 to connect that strap to the bracket 146 on the rear support assembly. Each strap 142 and 144 also includes a second hole 154 at the opposite end of that strap from hole 150. The hole 154 in strap 142 is arranged to be aligned with a hole 150 in the bracket 148 on the rear support assembly and with a linch pin extending therethrough to releasably connect that strap to that support assembly, In a similar manner the hole 154 in strap 144 is arranged to be aligned with a hole 150 in the bracket 148 on the front support assembly and with a linch pin extending therethrough to releasably connect that strap to that support assembly. This action effectively secures the upper ends of the two frame assemblies together, thereby resulting in a rigidly connected cart-like assembly, as shown in FIG. 4. When the system is in the operative configuration of FIG. 1, the ends of the straps including the holes 154 are not connected so that the connecting straps merely rest on the top of the extended boom as shown in FIG. 1.

When the system is in its cart-like configuration the bottom ends of each of the bracing struts 106 and 108 is secured to a boom section so that the strut extends along the underside of that boom section and is not free to swing about. The means for effecting such a connection is best seen in FIGS. 3 and 5 and basically comprises an apertured tab 190 fixedly secured, e.g., welded, to the side of front boom section 34A with the aperture 190A in the tab extending outward from the boom section. The aperture 190A is arranged to be aligned with one of the holes 110 in the lower end of the strut 106 so that a linch pin 82 can be extended therethrough to hold the strut to the boom section. The boom section 34C also includes a tab 190 fixedly secured thereon and whose aperture 190A is adapted to be aligned with one of the holes 110 in the lower end of the strut 108 so that a linch pin can be extended therethrough to hold that strut to that boom section.

As will be appreciated by those skilled in the art, when the system 20 is configured into the cart-like assembly of FIG. 4 it is adapted to be readily moved about the roof or stored, as the case may be, since it is quite compact. Moreover, the cart is arranged to carry thereon various components (not shown). To achieve that end, the cart includes a support shelf 156, preferably formed of a planar sheet, such as plywood, which is releasably secured to the base members 74 of the support assemblies 30 and 32. Thus, a pair of small, planar, mounting plates 158 are fixedly secured, e.g., welded, to the undersurface of the base member 74 of the front support assembly, while as second pair of plates 158 are similarly secured to the base member 74 of the rear support assembly. These plates serve to support the marginal edges of the shelf panel 156 thereon. With the shelf in place any desire component, supply, etc. may be conveniently stored thereon.

In order to facilitate the movement, e.g., rolling, of the system each of the caster assemblies is constructed to enable its associated caster to pivot about a vertical axis to any desired orientation so that the assembled system (whether in the operative configuration or the cart-like configuration) can be freely wheeled in any direction. In accordance with the preferred embodiment of the invention the caster assemblies also include lockable means to select a predetermined orientation for the caster, so that the caster can only roll in predetermined directions. Further still, locking means are provided to prevent the casters from rolling at all.

Figure 7:
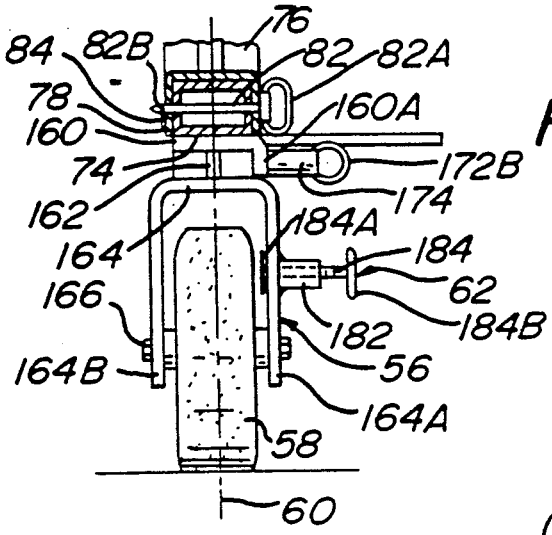
FIG. 7 is an enlarged, sectional view taken along line 7—7 of FIG. 6.
Figure 6:
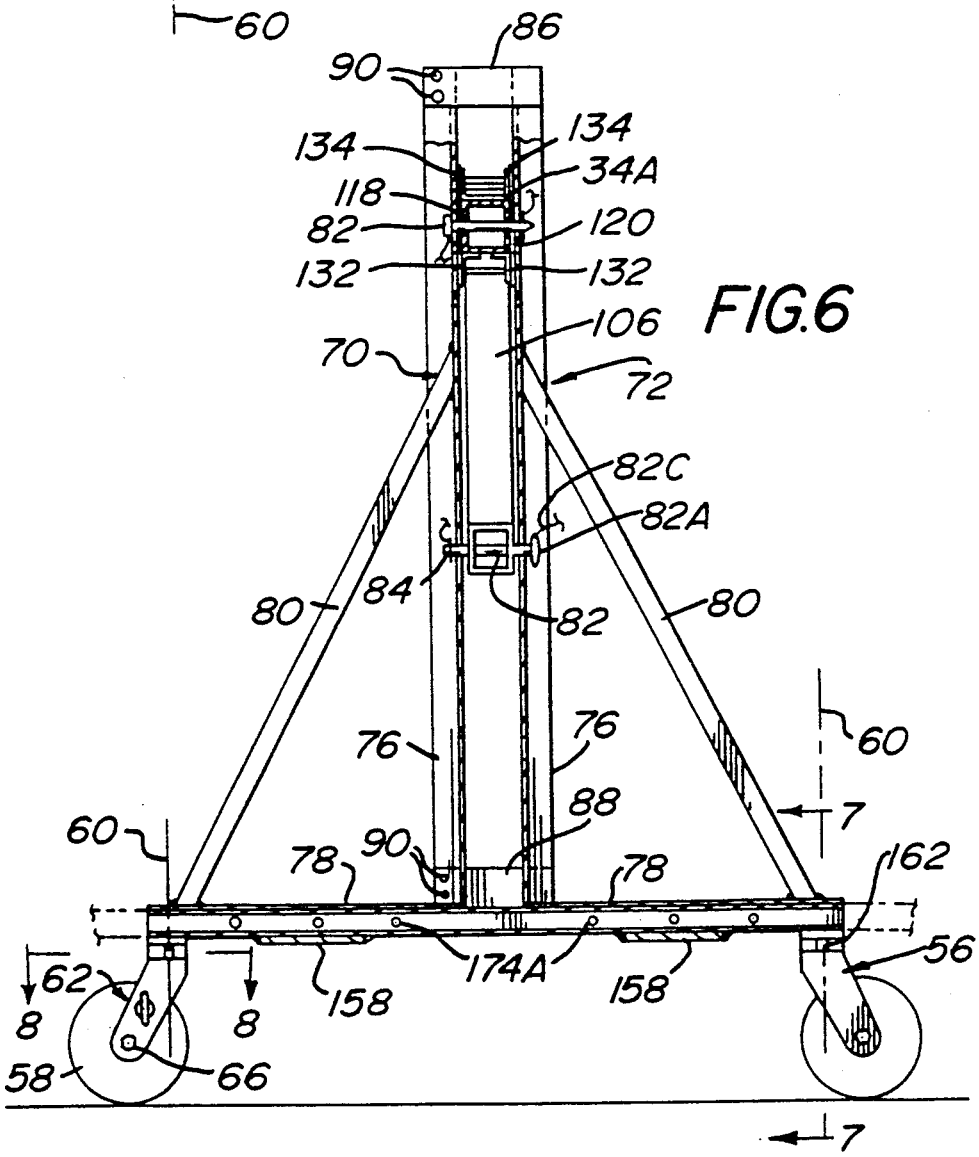
FIG. 6 is a front elevation view of the system shown in FIG. 1.

Referring now to FIGS. 5–8, the details of each of the caster assemblies 56 will now be described. As can be seen in FIG. 7 a caster assemblies is mounted onto the underside of the two base members 74 at each end thereof. Accordingly each corner of the assembled system 20 includes a caster assembly. Since the base member 74 of the rear support assembly 32 is longer than the base member of the front support assembly 30 the caster assemblies on the rear base member are spaced further apart than those of the front support assembly. Each caster assembly includes a flanged mounting plate 160 which is fixedly secured, e.g., welded, to the underside surface of the associated base member 74. A caster shaft 162 extends downward through a hole (now shown) in the mounting plate 160 and terminates at its bottom end in a yoke 164 which is fixedly secured, e.g., welded, thereto. The caster shaft forms the vertical axis about which the caster may rotate in all directions. The yoke includes a pair of arms 164A and 164B, each of which has a free end having an opening therein. The openings in the two arms are axially aligned to receive the axle 166 of the caster 56. As is conventional to facilitate the rolling of the caster the arms 164A and 164B of the yoke extend at an angle to the rotational axis 60, that is the axis of the caster shaft 162, so that the caster is laterally offset therefrom.

As mentioned earlier each caster assembly is arranged to be locked in a desired orientation. To that end, each assembly includes conventional means to enable it to be locked in one of four orientations, that is, with the caster 58 either arranged to be oriented parallel to the boom or transverse to the boom. Thus, each caster assembly includes a lockable caster plate 168 (FIG. 8). The caster plate is of circular cross section having four notches 170 at equidistantly spaced locations about its periphery. The caster plate is fixedly secured, e.g., welded, to the top of the yoke 164, with the caster shaft extending through a hole in the center of the caster plate, and is oriented so that two diametrically opposed ones of the notches 170 extend parallel to the longitudinal axis 68 of the boom assembly, while the other diametrically opposed notches 170 extend transverse to that axis. The caster mounting plate 160 includes a downwardly extending flange 160A which is arcuate in shape and extends beside a portion of the periphery of the lockable caster plate 168 (See FIG. 8). The flange 160A serves to support thereon a locking pin subassembly. That subassembly includes a locking pin 172 having a free end 172A which is arranged to be extended to fit within any selected one of the four notches 170 to preclude the caster from rotating about the axis of its shaft 162. The pin 172 also includes a head 172B in the form of a ring which can be readily grasped by the user. The pin is supported on the flange 160A via a mounting bracket 174. A compression spring 176 is disposed within the mounting bracket between an end wall thereof and a washer 178 disposed about the pin close to its free end 172A. The spring 176 tends to bias the pin with respect to the flange so that its free end attempts to enter any notch 170 aligned therewith. The pin can be retracted by pulling on its ring 172 against the bias of the spring to remove its free end 172A from the notch. This action frees the caster 56 to rotate about the longitudinal axis of its shaft. The pin is arranged to be held in this retracted position by twisting the pin about its longitudinal axis through a predetermined length arc. When this occurs means (not shown) holds the pin in the retracted position until it is twisted back through that arc.

As should be appreciated from the foregoing, if it is desired to roll the system in any direction (linear or curved), and to be able to change directions readily, the spring-loaded pin of each caster assembly is pulled to its retracted position and twisted, thereby freeing the caster to assume any orientation with respect to axis of its shaft. The system 20 can then be freely rolled about.

When the system is in its operative position, i.e., adjacent the roof edge like that shown in FIG. 2, the casters are oriented so they extend parallel to the edge of the roof. This action ensures that the system can only roll parallel to the edge of the roof. If it is desired to position the system either further or closer to the edge of the roof the spring-loaded pins of the caster assemblies are retracted to free the casters. The casters may then be rotated from the position shown in FIG. 1. The spring biased pins may then be extended so that their free ends enter into the associated notches 170 to lock the casters in this position. The assembly can then roll either toward or away from the edge of the roof.

In the event it is desired or necessary to lock the system 20 at any desired position, i.e., prevent it from rolling at all, means are provided in the system to achieve that end. Such means basically comprises the heretofore mentioned caster lock subassembly 62. That subassembly is associated with each caster subassembly and is best seen in FIG. 7. Each subassembly 62 basically comprises a threaded sleeve 182 extending transversely through yoke arm 164A. A threaded clamping screw 184 extends through the sleeve 182 and includes disk or engagement shoe 184A located at its free end. The opposite end of the screw 184 includes a handle or head 184B. The engagement shoe 184A is adapted to frictionally engage a portion of the sidewall of the caster when the screw handle is twisted to draw the screw towards the caster. This action prevents the caster from rotating about its axle 166.

As should be appreciated from the foregoing, the system 20 comprises a plurality of modular components, e.g., the triangular frame subassemblies 70 and 72, the boom assembly 34, the base members and their associated caster assemblies 56 and caster wheel locking subassemblies 62, etc., which are arranged to be releasably secured together to form the cart-like configuration of FIG. 4 or the operative configuration of FIG. 1 via the use of fast acting releasably securement means, e.g., linch pins and associated clips. Moreover, the components, assemblies and subassemblies are dimensioned such that when the system is disassembled each of them may fit through a relatively small opening, e.g., a 24 inch hatch, to enable the components forming the system to be readily stored, and then transported through a building to its roof.

As mentioned earlier each of the linch pins 82 includes an associated clip or ring 84 to prevent the accidental disconnection thereof, with each linch pin and associated clip being connected together via a respective wire 82C. Further still, in accordance with preferred embodiment of the invention plural groups of linch pins 82 are connected together via a chain (not shown) which is secured to a portion of the frame of the system 20, to prevent the loss of the linch pins and associated clips. For example the linch pins and clips used to secure the triangular frame subassembly 70 to the base member 74 of the front support assembly are connected together by such a chain. The other subassemblies 70 and 72 are similarly constructed.

Without further elaboration the foregoing will so fully illustrate our invention that others may, by applying current or future knowledge, adopt the same for use under various conditions of service.

We claim:

1. A portable support system for use on the roof of a structure, said system being arranged to be readily configured as a self-supporting compact cart adapted to be readily rolled by pushing and/or pulling to any desired location, while also being arranged to be readily configured to a self-supporting operative state for location at an operative position adjacent the edge of said roof to support a person and/or object therefrom, said system comprising first and second wheeled frame assemblies and a boom assembly, said boom assembly comprising plural sections, each of said sections being moveable with respect to an adjacent section to enable said sections to be unfolded from a compact orientation when said system is configured as said cart to an extended orientation when said system is in said operative state, and vice versa, said frame assemblies being arranged for connection to respective portions of said boom assembly and being spaced apart by a first predetermined distance when said system is configured as said cart, while being spaced apart by a second, and greater, predetermined distance when said system is in said operative state, said boom assembly when in said extended orientation including a projecting portion which extends along a longitudinal axis beyond said first fame assembly to overhang the edge of said roof to support a person and/or object therefrom, each of said frame assemblies comprising a pair of spaced wheels, each of said wheels being in contact with the roof when said system is configured as said compact cart or in said operative state and being arranged to pivot to various orientations to enable said system to roll in various directions to facilitate the movement of said system on said roof without the user supporting said system, each of said wheels also being arranged to be locked into a first predetermined orientation.

2. The system of claim 1 wherein said boom assembly is arranged to hold said wheeled frame assemblies at said first predetermined distance when said system is configured as said cart, said system additionally comprising releasably securable connecting means for assisting said boom assembly to hold said wheeled frame assemblies at said first predetermined distance.

3. The system of claim 1 wherein said frame assemblies are each arranged to support said boom assembly at various elevations thereon when said boom assembly is in said extended orientation.

4. The system of claim 1 wherein said second frame assembly is arranged to support a weighted ballast thereon.

5. The system of claim 1 wherein said frame assemblies each comprise plural frame members releasably secured together by pin means.

6. The system of claim 1 wherein said boom sections are pivotally connected to each other.

7. The system of claim 1 wherein said boom sections include bracing means pivotably secured thereto.

8. The system of claim 6 additionally comprising releasably securable pin means to hold said boom sections in said extended orientation.

9. The system of claim 2 wherein said boom sections are pivotally connected to each other.

10. The system of claim 9 additionally comprising releasably securable pin means to hold said boom sections in said extended orientation.

11. The system of claim 3 wherein said boom sections are pivotally connected to each other.

12. The system of claim 11 additionally comprising releasably securable pin means to hold said boom sections in said extended orientation.

13. The system of claim 4 wherein said boom sections are pivotally connected to each other.

14. The system of claim 13 additionally comprising releasably securable pin means to hold said boom sections in said extended orientation.

15. The system of claim 5 wherein said boom sections are pivotally connected to each other.

16. The system of claim 15 additionally comprising releasably securable pin means to hold said boom sections in said extended orientation.

17. The system of claim 7 wherein said boom sections are pivotally connected to each other.

18. The system of claim 1 additionally comprising locking means for preventing at least one of said wheels from rolling.

19. The system of claim 3 wherein each of said frame assemblies is arranged to support said boom assembly at a different elevation than said other frame assembly.

20. The system of claim 1 wherein each of said frame assemblies comprises a pair of generally triangular frame-like subassemblies and a base member arranged to be readily secured thereto via said fastening means.

21. The system of claim 20 wherein said triangular subassemblies, when secured together, form a space in which respective portions of said boom assembly are located.

22. The system of claim 21 wherein said wheels are secured to said base member.

23. The system of claim 22 additionally comprising locking means for preventing at least one of said wheels from rolling.

24. The system of claim 1 additionally comprising shelf means for supporting objects thereon.

25. The system of claim 22 additionally comprising shelf means for supporting objects thereon.

26. A portable support system for use on the roof of a structure, said system being arranged to be readily configured as a compact cart adapted to be readily rolled to any desired location, while also being arranged to be readily configured to an operative state for location at an operative position adjacent the edge of said roof to support a person and/or object therefrom, said system comprising first and second wheeled frame assemblies and a boom assembly, said boom assembly comprising plural sections, each of said sections being moveable with respect to an adjacent section to enable said sections to be unfolded from a compact orientation when said system is configured as said cart to an extended orientation when said system is in said operative state, and vice versa, said frame assemblies being arranged for connection to respective portions of said boom assembly and being spaced apart by a first predetermined distance when said system is configured as said cart, while being spaced apart by a second, and greater, predetermined distance when said system is in said operative state, said boom assembly when in said extended orientation including a projecting portion which extends along a longitudinal axis beyond said first frame assembly to overhang the edge of said roof to support a person and/or object therefrom, each of said frame assemblies comprising a pair of spaced wheels, each of said wheels being arranged to pivot to various orientations to enable said wheel to roll in various directions to facilitate the movement of said system on said roof, while also being arranged to be locked into a first predetermined orientation, said frame assemblies being of modular construction adapted to be readily assembled and disassembled via quick acting releasable securement means, and wherein each of said frame assemblies comprises a pair of generally triangular frame-like subassemblies and a base member arranged to be readily secured thereto via said fastening means.

27. The system of claim 26 wherein said triangular subassemblies, when secured together, form a space in which respective portions of said boom assembly are located.

28. The system of claim 27 wherein said wheels are secured to said base member.

29. The system of claim 28 additionally comprising locking means for preventing at least one of said wheels from rolling.

30. The system of claim 22 additionally comprising shelf means for supporting objects thereon.

* * * * *